United States Patent [19]

Bergami, Jr. et al.

[11] 4,049,196

[45] Sept. 20, 1977

[54] FIREPLACE HEATER, CIRCULATOR, AND HUMIDIFIER SYSTEM

[76] Inventors: Samuel S. Bergami, Jr., 18 King St.; Samuel S. Bergami, Sr., 192 York St., both of West Haven, Conn. 06516

[21] Appl. No.: 664,529

[22] Filed: Mar. 8, 1976

[51] Int. Cl.[2] ..... F24B 7/00

[52] U.S. Cl. ..... 237/51; 126/121; 126/113; 33/126.7 R; 248/225.3

[58] Field of Search ..... 237/51; 126/120–122, 126/125, 202, 134, 131, 142, 113; 55/99; 33/126.7 R; 248/226 A, 188.5

[56] References Cited

U.S. PATENT DOCUMENTS

| | | | |
|---|---|---|---|
| 2,052,643 | 9/1936 | Modine | 126/121 |
| 2,120,977 | 6/1938 | Holz | 126/121 |
| 2,285,725 | 6/1942 | Kneedler | 126/113 |
| 3,166,849 | 1/1965 | Chisholm | 33/126.7 R |
| 3,685,506 | 8/1972 | Mouat | 126/121 |
| 3,746,295 | 7/1973 | Stepanek et al. | 248/226 A |
| 3,901,212 | 8/1975 | Stites | 126/121 |
| 3,915,102 | 10/1975 | Barron | 248/188.5 |
| 3,930,491 | 1/1976 | Miller | 237/51 |
| 3,955,553 | 5/1976 | Soeffker | 126/121 |
| 4,008,707 | 2/1977 | Bartlett | 126/121 |

*Primary Examiner*—John J. Camby
*Assistant Examiner*—Henry C. Yuen
*Attorney, Agent, or Firm*—Mattern, Ware, Davis and Stoltz

[57] ABSTRACT

By providing a completely enclosed air heating and exchanging system which is quickly and easily mounted in a conventional fireplace and which incorporates a humidification unit, a unique fireplace heater, circulator and humidifier system is provided. In the preferred embodiment, the heater, circulator and humidifier system is mounted along the upper edge of the open fireplace hearth with the air circulation chamber of the system extending into the fireplace heating zone and a fan for driving the air through the system. Furthermore, if desired, the unit may incorporate a thermostat control for cycling the fan motor on and off to a desired temperature.

2 Claims, 4 Drawing Figures

FIREPLACE HEATER, CIRCULATOR, AND HUMIDIFIER SYSTEM

BACKGROUND OF THE INVENTION

This invention relates to auxiliary fireplace heater, circulator systems, and more particularly to auxiliary fireplace systems incorporating humidification units.

With the ever increasing cost of fuel for heating homes, much effort has been devoted to employing conventional fireplaces in a manner which would allow them to become more efficient in heating either an entire room or an entire home. These prior art units have been extremely cumbersome, difficult to install, and of generally poor design. Although much effort has been expended in developing an auxiliary fireplace system which would allow a conventional fireplace to become more efficient in heating a particular area, these units have suffered from various deficiencies.

Generally, the prior art units, which have concentrated on providing added heat to a single room while being easily installable, have suffered from the inability to provide enough air circulation to adequately heat a single room. Furthermore, most of these units have employed systems which surround the fire itself and therefore become cumbersome in allowing easy use and cleaning of the fireplace bed.

Although the deficiencies and problems of these various prior art units vary considerably from unit to unit, one deficiency which each and every prior art system completely suffers is the total inability of any of the prior art systems to impart water vapor into the heated air which is circulated in the room. Because of this deficiency, many individuals have decided not to use their fireplaces and not to invest in any air circulation system. This decision is based on the fear that the continuous use of the system with the fireplace will deplete their already low level of humidification, and cause extremely undesirable side effects throughout the entire home.

Therefore, it is a principal object of the present invention to provide an auxiliary fireplace system which heats and circulates the air while also incorporating a humidification unit which imparts water vapor to the heated and circulated air.

Another object of this invention is to provide the fireplace heater, circulator, and humidifier system in accordance with the above description which is easily installed in a conventional fireplace.

Another object of this invention is to provide the circulator, heater and humidifier system in accordance with the above description wherein the air circulation chamber is positioned in direct contact with the heated air from the fire but away from the greatest concentration of heat, in order to prevent degradation of the chamber material.

A further object of the present invention is to provide a heater, circulator, and humidifier system in accordance with the above description wherein the amount of air circulation is automatically controlled by the temperature of the air being circulated.

Other and more specific objects will in part be obvious and will in part appear hereinafter.

SUMMARY OF THE INVENTION

The fireplace heater, circulator, and humidifier system of the present invention comprises extremely unique aspects and synergistic results by incorporating within the enclosed air circulation chamber a humidifying unit which imparts moisture to the heated air exiting from the circulation zone. In this way, greater utility of the fireplace is provided, since uniformly heated air is completely distributed throughout the entire room, and much needed water vapor is added to the heated air. In this way, the difficulties and reservations encountered with the myriad of prior art units are all completely eliminated and a unique, synergistic result is achieved.

In the preferred embodiment, the fireplace heater, circulator, and humidifier system of the present invention is installed in the fireplace unit along the top edge of the open fireplace hearth. In this way, the air circulation chamber extends into the hearth above the fire itself, just below the flue and exit to the chimney. As a result, the concentrated heat of the fire is avoided, and rapid heat degradation of the circulation chamber is eliminated. Furthermore, since the heater, circulator and humidifier system of the present invention is spaced well above the fire zone itself, clean-up and maintenance of the fire is easily achieved, without any interference being caused by the system of this invention.

The invention accordingly comprises the features of construction, combination of elements, and arrangement of parts which will be exemplified in the construction hereinafter set forth, and the scope of the invention will be indicated in the claims.

THE DRAWINGS

DETAILED DESCRIPTION

Figure 1:
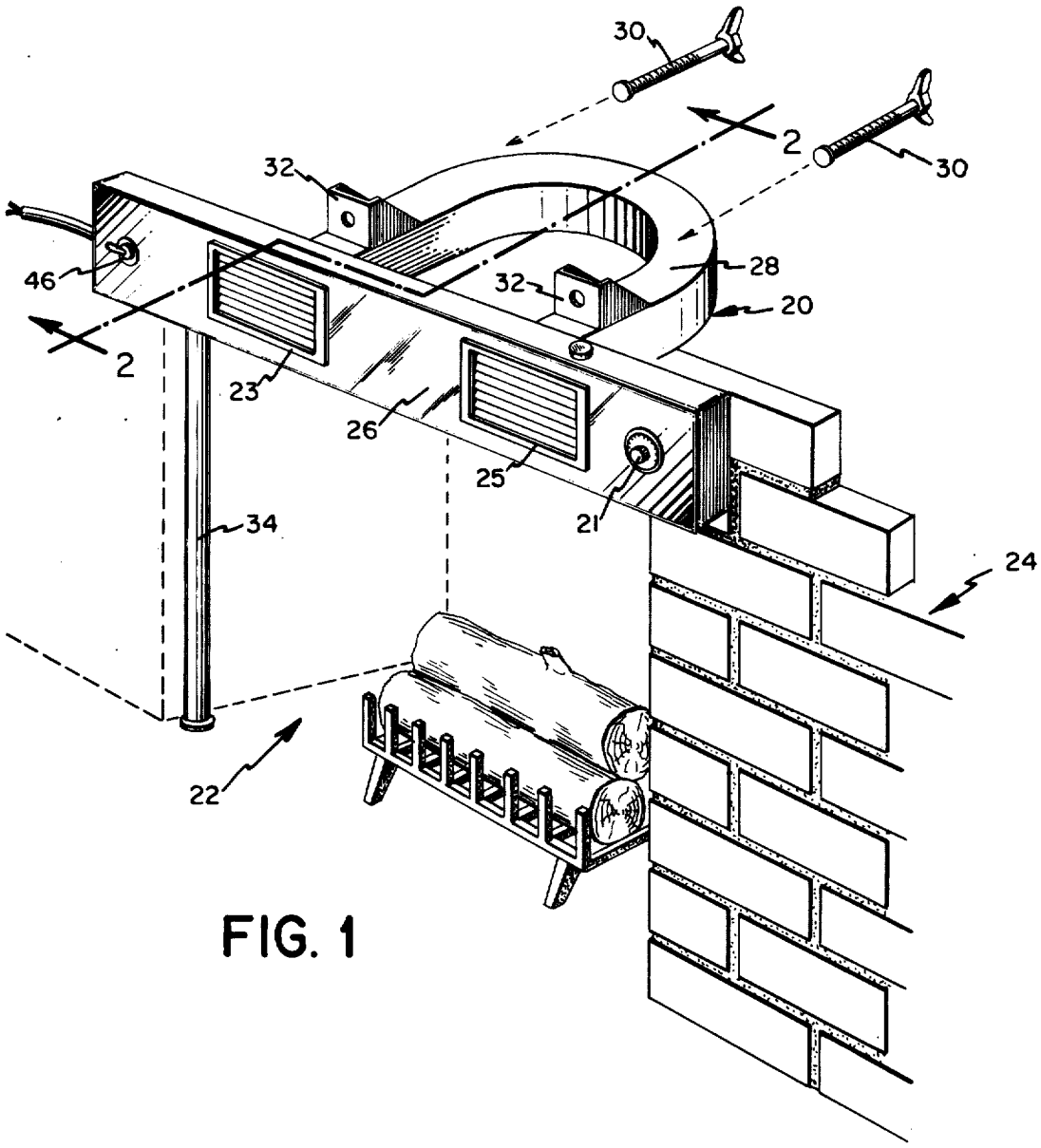
FIG. 1 is a perspective view of the heater, circulator and humidifier system of the present invention mounted in a conventional fireplace.

As shown in FIG. 1, the combination heater, circulator and humidifier system 20 of the present invention is shown in its preferred position mounted along the top edge of an open hearth 22 of a typical fireplace 24. Heater, circulator and humidifier system 20 comprises a housing 26 and an enclosed air circulation chamber 28. Chamber 28 is preferably U-shaped and is connected at both ends to the rear panel of housing 26. In the preferred embodiment, housing 26, which is the only visible portion of system 20 when installed, incorporates a circulating fan and a humidification unit within the housing and a louvered inlet panel 23, a louvered outlet panel 25, a thermostat control 21, and a fan control switch 46 along its forward facing front surface.

By providing a heater, circulator and humidifier system which is mounted along the top of open hearth 22 of fireplace 24, several advantages unobtainable with prior art units are achieved. One such advantage is the use of the enclosed air circulation chamber 28 which is substantially identical to the height of a typical brick. As a result, the mounting of heater, circulator and humidifier system 20 to fireplace 24 provides fireplace 24 with the equivalent of an additional row of bricks extending along the upper edge of open hearth 22. As a result, the convective currents of open hearth 22 are improved and the entry of smoke into the room is eliminated. Another extremely important advantage achieved by the position of heater, circulator and humidifier system 20 is the ability of air circulation chamber 28 to receive full effect of the heated air from the burning fire in the open hearth 22 without interferring in any way with the fire or the clean up of ashes.

Furthermore, its position spaced above the actual fire allows the air circulating through chamber 28 to be thoroughly heated, while preventing unnecessary high concentration of heat in any area along chamber 28 which may result in deterioration of the chamber itself. As a result, this position allows complete and normal use of fireplace 24 without any interference or adverse effect in its typical operation.

Figure 2:
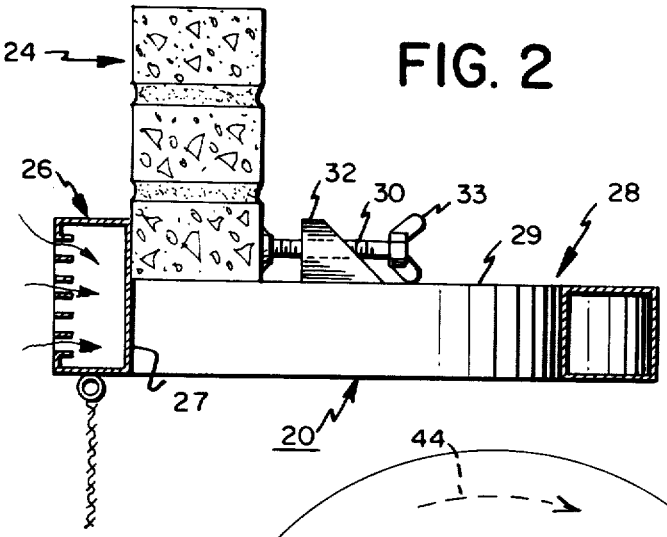
FIG. 2 is a cross-sectional side elevation view of the fireplace heater, circulator, and humidifier system of the present invention taken along line 2—2 of FIG. 1.

One of the major advantages of the combination heater, circulator and humidifier system 20 is the quick, easy, trouble-free installation capabilities of the system. By referring to FIGS. 1 and 2, the simple installation capabilities can best be understood. As mentioned above, heater, circulator and humidifier system 20 is preferably mounted along the top edge of the open hearth 22 of fireplace 24. One mounting system for achieving a secure, trouble-free installation of heater, circulator and humidifier system 20 on fireplace 24 is the use of clamping bolts 30 in combination with brackets 32 which are mounted to top surface 29 of chamber 28.

In order to mount heater, circulator and humidifier system 20 of fireplace 24, rear surface 27 of housing 26 is positioned directly abutting the first row of bricks forming the lower edge of fireplace 24, with top surface 29 of chamber 28 contacting the bottom surface of the bricks in this lower row. With heater, circulator and humidifier system 20 manually held in this position, clamping bolts 30, which are threadedly engaged in brackets 32, are rotated by means of wing nuts 33 until the lower row of bricks of fireplace 24 is securely sandwiched between rear surface 27 of housing 26 and clamping bolts 30. Clearly, as clamping bolts 30 are rotated, the bolt advances toward the rear of the bricks of fireplace 24 until firmly and securely clamping heater, circulator and humidifier 20 in position, secured in this position by the clamping forces exerted by bolts 32 and rear surface 27 of housing 26. Once both bolts 30 are securely clamped, heater, circulator and humidifier 20 are mounted in position ready for operation.

Figure 3:
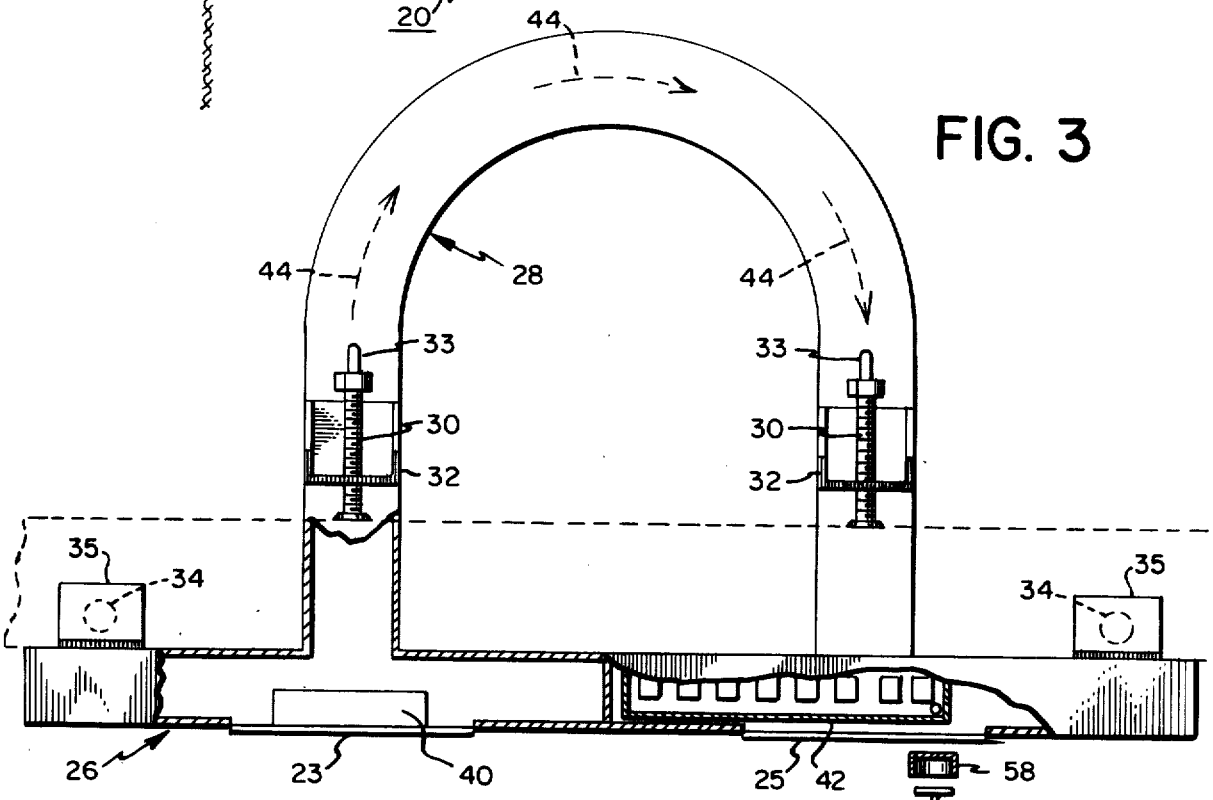
FIG. 3 is a top plan view, partially in cross-section, of the fireplace heater, circulator, and humidifier system of the present invention.

Although the use of clamping bolts 30 and brackets 32 are preferred for securing heater, circulator and humidifier system 20 to fireplace 24, other mounting methods can be employed in order to securely mount heater, circulator and humidifier system 20 in its desired position. As shown in FIGS. 1 and 3, one alternative mounting system is to employ brackets 35 mounted to the bottom surface of housing 26 with adjustable legs 34 extending vertically downwardly from brackets 35 to the floor of open hearth 22 of fireplace 24, substantially in alignment with the fireplace wall. Using the adjustable legs 34, heater, circulator and humidifier system 20 can be easily and quickly installed in position and securely maintained in position by supporting legs 34. Furthermore, the adjustability of legs 34 will provide the universality required to fit any size fireplace hearth.

As shown in FIG. 3, heater, circulator and humidifier system 20 incorporates a circulation fan 40 and a humidification unit 42 in housing 26. By incorporating circulation fan 40 in heater, circulator and humidification system 20 the desired quantity of airflow through system 20 is achieved for providing beneficial results to the overall temperature and humidification level of the room.

Preferably, fan 40 comprises a typical industrial panel mounted fan which is capable of circulating air between 75 and 100 cubic feet per minute without interfering or restricting the airflow by its position adjacent to entry louver panel 23. As mentioned above, enclosed airflow chamber 28 is interconnected at both ends thereof with the rear of housing 26. Consequently, an airflow path is established from the room into heater, circulator and humidifier system 20 through louvered panel 23, into enclosed chamber 28, around chamber 28 (as shown by flow path arrows 44), over humidification unit 42, and back into the room through louvered panel 25.

Furthermore, the location of fan 40 is extremely important for the safe and efficient operation of system 20. By positioning fan 40 in close proximity to inlet panel 23, the room air is drawn into system 20 and then forced through chamber 28 by the pressure developed by fan 40. In this way, a positive pressure exists throughout enclosed chamber 28. This positive pressure assures that no smoke, carbon dioxide, or carbon monoxide could possibly be drawn into chamber 28 from hearth 22 if any undetected hole or other type of rupture were to occur in chamber 28. Consequently, the safe, care-free operation of system 20 is assured.

As the room air circulates through enclosed chamber 28, the air is heated from the heat generated by the fire in the hearth 22. As a result, cooler air from the room is heated as the air passes through chamber 28 and the heated air is then returned to the room to provide an even, elevated temperature level throughout the entire room. It has been found that heater, circulator and humidifier system 20 can produce about 12,000 BTU's per hour. Furthermore, since exit louver panel 25 is pitched upwardly, as shown in FIG. 1, the heated air is forced upwardly into the room above the natural suction of the fireplace. In this way, the system's construction provides assurance that the air heated in system 20 will be circulated directly into the room and not drawn into the fireplace.

Figure 4:
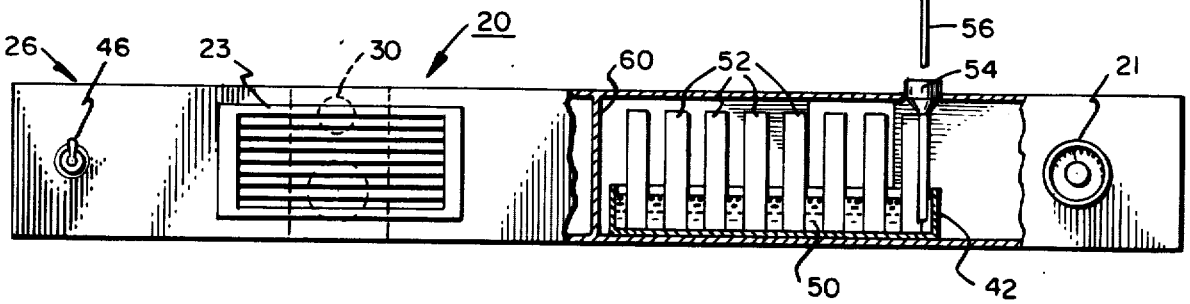
FIG. 4 is a front elevation view of the fireplace heater, circulator, and humidifier system of the present invention.

Another extremely important feature of the heater, circulator and humidifier system 20 which clearly distinguishes system 20 from all prior art systems is the incorporation therein of humidifier unit 42. In the preferred embodiment, humidification unit 42 is positioned within housing 26 as shown in FIGS. 3 and 4. Although a variety of humidification systems could be employed, in the preferred embodiment, humidification unit 42 comprises a container 50, and upstanding wicks 52. For convenience, a fill tube 54, a measuring stick 56, and a cap 58 are also employed. In this way, the level of water can be quickly and easily checked by removing cap 58 and checking the water level on dip stick 56. If water is required, the water is easily poured through fill tube 54 into container 50.

In operation, the heater air circulating through chamber 28 passes between upstanding wicks 52 and draws water vapor therefrom, humidifying the heated air which then immediately exits through panel 25 into the room. Wicks 52, made of clay or cardboard, are well-known in the art and any such suitable wicks can be employed. The general humidification principal is also well-known in the art wherein the wicks draw the water from container 50 and remain constantly moist while the heated air passing therebetween draws the water vapor from the wicks, saturating the air passing therebetween.

As discussed above, a constant problem prevalent in the use of fireplaces as well as prior art fireplace heaters and circulators is the difficulty encountered with reducing the humidification level in the room due to the dry hot air entering the room. By incorporating a humidification unit directly within the heater, circulator, and humidifier system 20 a unique and synergistic result is achieved. The heretofore undesirable features of prior art systems are completely supplanted and a totally new concept achieved, not only making prior art systems obsolete but also providing a new dimension to the fireplace which was heretofore completely unobtainable. Furthermore, system 20 provides added dimension in its ability to be employed as a humidifier alone when no fire is being used in the fireplace 24. As long as water is present within container 50, and air circulates over wick 52 the moisture content of the room can be easily controlled by system 20.

In the preferred embodiment, container 50 comprises sufficient area for holding at least one gallon of water, in order to allow for trouble-free operation of system 20 for several hours without requiring refilling. Of course, as would be obvious to one skilled in the art, any size container can be employed as well as any alternative type of humidification unit without departing from the scope of this invention.

As shown in FIG. 4, in the preferred embodiment, a divider 60 is mounted within housing 26 in order to divide the entry chamber of housing 26 from the exit chamber, thereby preventing the possibility of having the cold air circulating directly over humidifiction unit 42 and back to the room without being heated.

One additional feature incorporated on heater, circulator and humidifier system 20 is thermostat 21 which is preferably mounted on front panel of housing 26. Thermostat 21 provides the user with the ability to set a particular temperature for the heated air exiting into the room, thereby automatically controlling the temperature level of the room. In operation, the temperature of the air exiting through panel 25 is sensed by thermostat assembly 21 and when a desired temperature level is reached the circulation motor 40 is automatically shut off. As is well-known in the art for construction and operation of thermostats, when the temperature of the air above the center reaches another level, circulation fan 40 will automatically begin and heated air circulating into the room will commence again. In this way, the use of system 20 can be completely automatic in order to maximize the convenience to the user. However, as mentioned above, an on-off switch 46 to manually control circulation 40 is also mounted on housing 26 in order to provide manual control of the circulation fan if such is desired.

It will thus be seen that the objects set forth above, among those made apparent from the preceding description, are efficiently attained and, since certain changes may be made in the above construction without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention in which, as a matter of language, might be said to fall therebetween.

Having described our invention, what we claim as new and desire to secure by Letters Patent is:

1. A heater, circulator and humidifier system for installation in conventional fireplaces comprising:

A. an enclosed air circulation chamber incorporating
  a. a forward, substantially rectangular hollow, air-conducting housing portion having a horizontal length slightly greater than the horizontal fireplace hearth opening and a vertical width substantially equal to the width of two bricks, thereby providing a housing portion which is dimensioned to be compatible with any conventional fireplace with a minimum of conspicuousness; and
  b. a substantially U-shaped in plan, hollow, air-conducting portion having forward, free open ends in air-conducting relationship with rear wall of the rectangular portion and rearwardly extending therefrom substantially perpendicularly to the rear wall of the rectangular portion;
  c. an overall substantially L-shaped configuration in a side elevation with the housing portion forming the base of the L and the U-shaped portion forming the vertical leg of the L, adapted for installation in a fireplace with the L rotated 90°, whereby the entire air circulation chamber when installed in position provides a substantially flat horizontal planar lower surface extending from the front of the fireplace to the rear thereof;

B. an inlet portal formed in said housing portion for directing air into said chamber;

C. an outlet portal formed in said housing portion for directing air circulating within said chamber out of the chamber;

D. an air circulation fan mounted in said housing portion in juxtaposed relationship with said inlet portal, whereby the air drawn from the room is drawn into said inlet portal and forced therefrom through the entire air circulation chamber, thereby providing a positive circulation pressure throughout;

E. a humidification unit mounted within said housing portion in juxtaposed spaced relationship to said outlet portal and incorporating
  a. a water container mounted in said housing portion in juxtaposed spaced relationship to said outlet portal,
  b. a plurality of upstanding water absorbing members positioned in said water container and extending above the water level into the air flow path,
  c. a fill tube extending from an external surface of said housing portion into said water container, providing easy replacement of water into said container, and
  d. an elongated water level measuring stick cooperating with said fill tube for determining the level of water in said container;

F. mounting means for securely maintaining said system along the lower horizontal row of bricks of said fireplace defining the open hearth and comprising
  a. brackets mounted to the top surface of said rearwardly extending substantially U-shaped portion, and
  b. screw clamp assemblies
    1. threadedly engaged in said brackets for cooperative association with the rear surface of said housing portion, and 2. incorporating wing nuts mounted on one end thereof, enhancing the ease of manual rotation of said clamping bolts into their secure position;

G. thermostat means for controlling the flow of heated air through said system depending upon the temperature thereof; and H. switch means connected to said air circulation means for manually controlling the air circulation.

2. A heater, circulator and humidifier system for installation in conventional fireplaces comprising:

A. an enclosed air circulation chamber incorporating a. a forward, substantially rectangular hollow, air-conducting housing portion having a horizontal length slightly greater than the horizontal fireplace hearth opening and a vertical width substantially equal to the width of two bricks, thereby providing a housing portion which is dimensioned to be compatible with any conventional fireplace with a minimum of conspicuousness; and b. a substantially U-shaped in plan, hollow, air-conducting portion having forward, free open ends in air-conducting relationship with rear wall of the rectangular portion and rearwardly extending therefrom substantially perpendicularly to the rear wall of the rectangular portion;

c. an overall substantially L-shaped configuration in a side elevation with the housing portion forming the base of the L and the U-shaped portion forming the vertical leg of the L, adapted for installation in a fireplace with the L rotated 90°, whereby the entire air circulation chamber when installed in position provides a substantially flat horizontal planar lower surface extending from the front of the fireplace to the rear thereof;

B. an inlet portal formed in said housing portion for directing air into said chamber;

C. an outlet portal formed in said housing portion for directing air circulating within said chamber out of the chamber;

D. an air circulation fan mounted in said housing portion in juxtaposed relationship with said inlet portal, whereby the air drawn from the room is drawn into said inlet portal and forced therefrom through the entire air circulation chamber, thereby providing a positive circulation pressure throughout;

E. a humidification unit mounted within said housing portion in juxtaposed spaced relationship to said outlet portal and incorporating a. a water container mounted in said housing portion in juxtaposed spaced relationship to said outlet portal, b. a plurality of upstanding water absorbing members positioned in said water container and extending above the water level into the air flow path, c. a fill tube extending from an external surface of said housing portion into said water container, providing easy replacement of water into said container, and d. an elongated water level measuring stick cooperating with said fill tube for determining the level of water in said container;

F. mounting means for securely maintaining said system along the lower horizontal row of bricks of said fireplace defining the open hearth and comprising a. a bracket mounting to said housing portion and rearwardly extending therefrom, and b. adjustable leg members extending from said brackets to the floor of the open hearth of said fireplace;

G. thermostat means for controlling the flow of heated air through said system depending upon the temperature thereof; and H. switch means connected to said air circulation means for manually controlling the air circulation.

* * * * *